US007571763B2

(12) United States Patent
Schimp

(10) Patent No.: US 7,571,763 B2
(45) Date of Patent: Aug. 11, 2009

(54) METHOD AND APPARATUS FOR RECOVERING AND TRANSPORTING METHANE GAS

(75) Inventor: Christopher E. Schimp, Eldorado, IL (US)

(73) Assignee: Compressed Energy Systems, LLC, Eldorado, IL (US)

( * ) Notice: Subject to any disclaimer, the term of this patent is extended or adjusted under 35 U.S.C. 154(b) by 6 days.

(21) Appl. No.: 11/726,235

(22) Filed: Mar. 21, 2007

(65) Prior Publication Data

US 2007/0221382 A1 Sep. 27, 2007

Related U.S. Application Data

(60) Provisional application No. 60/784,412, filed on Mar. 21, 2006.

(51) Int. Cl.
*F17C 13/00* (2006.01)

(52) U.S. Cl. ..... 166/53

(58) Field of Classification Search ..... 405/52, 405/53

See application file for complete search history.

(56) References Cited

U.S. PATENT DOCUMENTS

| | | | |
|---|---|---|---|
| 3,277,654 | A | 10/1966 | Shiver |
| 3,331,206 | A | 7/1967 | Osborne |
| 3,807,181 | A | 4/1974 | Kuhne |
| 4,085,800 | A | 4/1978 | Engle et al. |
| 4,159,037 | A | 6/1979 | Varnon et al. |
| 4,161,047 | A | 7/1979 | Riley |
| 4,300,632 | A | 11/1981 | Wiberger et al. |
| 4,380,265 | A | 4/1983 | Mohaupt |
| 4,417,829 | A | 11/1983 | Berezoutzky |
| 4,474,053 | A | 10/1984 | Butler |
| 4,741,395 | A | 5/1988 | Reed et al. |
| 5,607,016 | A | 3/1997 | Butler |
| 5,921,321 | A | 7/1999 | Sepich |
| 5,942,469 | A | 8/1999 | Juprasert et al. |
| 6,108,967 | A | 8/2000 | Erickson |
| 6,176,317 | B1 | 1/2001 | Sepich |
| 6,209,350 | B1 | 4/2001 | Kimble |
| 6,554,368 | B2 | 4/2003 | Drake et al. |
| 6,808,693 | B2 | 10/2004 | Arnaud et al. |
| 6,869,147 | B2 | 3/2005 | Drake et al. |
| 7,056,062 | B2 | 6/2006 | Takeuchi et al. |
| 2002/0029585 | A1 | 3/2002 | Stone et al. |
| 2004/0136784 | A1 * | 7/2004 | Dahlem et al. ..... 405/52 |
| 2005/0022416 | A1 | 2/2005 | Takeuchi et al. |

(Continued)

*Primary Examiner*—John Kreck
(74) *Attorney, Agent, or Firm*—James B. Surber; Bryan Cave LLP

(57) ABSTRACT

This invention relates to the field of the recovery of methane gas from a coal mine and conventional Natural Gas. More particularly, it involves an apparatus and method for economically recovering methane gas from a coal mine and transporting the methane gas to an end user or other location. The invention further provides an apparatus and method for economically recovering Natural Gas that is stranded due to high impurities that requires processing and/or Natural Gas that is not located near a pipeline. According to a first preferred embodiment of the invention, such methods for recovering and transporting gas comprise (a) transferring gas from a producing well to a first subterranean capacitor and storing the gas in said capacitor and (b) transferring gas from the first subterranean capacitor to a second subterranean capacitor, a pipeline, an end user, a gas processor, or a power plant.

12 Claims, 3 Drawing Sheets

U.S. PATENT DOCUMENTS

2006/0048920 A1 3/2006 Helleur
2006/0120806 A1 6/2006 Leone et al.
2006/0254765 A1 11/2006 Pfeiffer et al.

* cited by examiner

METHOD AND APPARATUS FOR RECOVERING AND TRANSPORTING METHANE GAS

CROSS-REFERENCE TO RELATED APPLICATIONS

This application claims priority to, and incorporates by reference, U.S. provisional patent application Ser. No. 60/784,412, filed Mar. 21, 2006.

FIELD OF THE INVENTION

This invention relates to the field of the recovery of methane gas from a coal mine and conventional Natural Gas. More particularly, it involves an apparatus and method for economically recovering methane gas from a coal mine and transporting the methane gas to an end user or other location. The invention further provides an apparatus and method for economically recovering Natural Gas that is stranded due to high impurities that requires processing and/or Natural Gas that is not located near a pipeline.

BACKGROUND OF THE INVENTION

As coal is mined, a large amount of methane gas accumulates in the mine. Sometimes this methane gas is simply vented to the atmosphere or burned off. At other times, it is allowed to accumulate.

Much attention has recently been focused on emission standards, particularly for high volume public utilities such as power plants. Power plants commonly use co-firing boilers to produce electricity. However, much of the coal available in the United States has high contents of sulfur dioxide or nitrogen dioxide, two substance emissions which are particularly undesirable for the environment. Many environmental regulations require the reduction of the use of high sulfur content coal in public utilities. One alternative to meeting these emission standards is to pay a penalty for such sulfur dioxide emissions. It is therefore an object of this invention to provide an economical alternative to the payment of these environmental penalties due to the burning of sulfur dioxide laden coal.

Many coal boilers which emit sulfur dioxide, nitrogen dioxide, and green house gases (GHG) are currently in use in the United States. However, these boilers may be easily converted to a co-firing system at a low capital cost. This ease of conversion, along with the economic value of the converted system, make co-firing coal with gas a low risk approach to using coal mine gas as a substitute for coal. Co-firing with gas improves ash quality, reduces slag build-up, and can slightly increase boiler efficiency. The gas fuel input may vary from less than 3% to 100% of the total fuel input, increasing the short term peaking capability of the coal fire burner.

Many utility boilers now have co-firing capabilities, many of which are situated near gassy coal mines. Gassy coal mines are coal mines in which a large amount of methane gas exists. The methane gas is absorbed by the underground coal and seeps out in salvageable quantities.

In order to determine which boilers would be ideal for co-firing with coal mine gas, operators must consider the gas demand and availability, pipeline distances, and boiler conversion costs. Because co-firing is an ideal application for variable quality coal mine gas, the U.S. EPA is researching the economic potential to site new co-fired boilers at gassy coal mines to employ coal, coal mine gas, and ventilation air as fuels. One other alternative to siting these boilers at or near gassy coal mines is to develop an economical way to recover the methane gas from the mine and economically transport it to already existing boiler sites.

It is therefore another object of this invention to provide an alternative means of transportation for coal mine gas, involving a set of specially prepared tankers to transport the methane coal mine gas from the mine to the consumption site.

While co-firing gas at co-fired industrial and utility boilers is economically compelling, heretofore there have been great difficulties encountered in the transportation of the coal mine gas to suitable end-user facilities. If a method could be devised to economically capture coal mine gas into tanks and if transportation costs could be held down, the economies of the use of coal mine gas would be greatly increased. In addition, emission credits and avoided penalties could substantially improve the economics of most coal mine gas projects, thereby stabilizing coal use for utilities. It is therefore a still further object of this invention to provide a suitable means of transportation for recovered coal mine gas which partially uses the coal mine gas recovered as fuel for the transportation means.

It is also an object of this invention to provide a suitable means of transportation for recovered coal mine gas which is transported to a gas processing plant, where the inerts are removed such as nitrogen, carbon dioxide, and hydrogen sulfide and water. After the removal of the inerts, the gas is then pipeline quality, where it can be put into a major pipeline as Natural Gas.

A major problem with the collection of coal mine gas is that methane cannot be economically collected for transport because the coal mines in which the gas exists are spread out over a large area. The large area would require miles of pipeline. However, existing utility pipelines cannot be used because the nitrogen and carbon dioxide levels in the methane gas are too high for pipeline gas quality. Further, methane will not liquefy like propane gas unless it is frozen to 210 degrees below zero by use of cryogenics. The cryogenic solution is quite costly.

Also, it has been found that the production of coal mine gas from one area is not typically enough to economically justify the installation of a small gas processing plant. It takes several areas which are typically far apart, making the laying of pipeline to join those areas to one localized gas processing plant not economically feasible.

If methane gas is introduced into a bulk transport system or Compressed Natural Gas (CNG) System tanker, hereinafter also referred to by the term "tanker", to transport, the costs are very high due to the expensive vessels of the tankers that hold the gas at high pressures, at or above 3000 psi. The vessels for holding the gas at the compression site are costly due to taking twice as much volume to load the transport quickly. Also, unloading takes time, such that the transport has to be left while the end user such as a gas processing plant, takes the gas from the tanker at a reasonable rate into the plant for processing. To unload quickly presently takes expensive tanks at the unloading facility, and the tanks are typically required to have twice the volume for the tanker, to allow the tanker to be unloaded quickly.

SUMMARY OF THE INVENTION

According to a preferred aspect of the invention, readily available commercial CNG transport trailers or tankers are utilized; however, such tankers are not required to be left at the unloading and loading sites for long periods of time. Instead, loading and unloading are accomplished quickly and efficiently. As a result, as few as one tanker can be used instead of multiple tankers, thereby providing a substantial cost advantage.

In most areas where coal mining is present, there is an abundance of unused or abandoned oil wells, and in some cases, oil wells that cover the countryside. For instance, in the southern region of the state of Illinois and in Kentucky, both of the United States, many of these wells are about 3000 feet deep with 8 inch casing that have been cemented into the ground. The formations in which they produce or formerly produced can be easily sealed off to keep fluids out and the gas in. Also, these wells can hold high pressures, for instance, 4,000 psi.

As a result, according to the invention, it has been found that just two wells, for instance, 8 inches in diameter by 3000 feet deep can be used as subterranean capacitors for holding twice as much compressed gas as the biggest and highest volume bulk transport tanker, at a high pressure, such as 3000 psi. With 600,000 cubic feet of gas (600 mcf) charged on site in two oil wells used as capacitors at this pressure, a tanker having a capacity of 300 mcf can be loaded with gas therefrom to this pressure very quickly, for instance, in less than half an hour.

Unused or abandoned oil wells are a liability for plugging if not operated. Many companies are willing to give them away due to plugging costs up to $5,000 per well. Thus, as an example, using oil wells in the capacity as subterranean capacitors can allow a compressor to operate 24 hours for filling the capacitors, enabling a smaller compressor to be used, steady flow from the production wells, and quick loading into the transport tanker to deliver the gas to the end user. Additionally, only one transport is needed instead of three.

At the unloading facility, similarly, one or more subterranean capacitors can be used, which can be, for instance, one or more producing or non-producing oil wells, an unused mine, a subterranean formation, or a subterranean cylinder. As used herein, a "subterranean cylinder" refers to a subterranean structure that is similar in size, dimension, and construction to an oil well. For example, a "subterranean cylinder" may consist of a hole drilled into the ground that is surrounded by, for example, several inches of cement casing. The hole is preferably lined with a material, such as steel or any other suitable liner. The subterranean cylinder may be constructed near the site of a producing well for the purpose of extracting gas from the producing well and storing the gas in the subterranean cylinder. In other words, the invention contemplates that, in addition to abandoned oil wells, newly constructed subterranean cylinders may be positioned near producing wells for the purpose of storing gas therein. A "producing well," as used herein, refers to any source of methane gas, Natural Gas, combinations thereof, and/or constituents thereof.

An advantage of using a subterranean capacitor according to the invention is that it will take gas quickly, but let it out slowly, which is what is typically required by end users, because the gas usage rate of the user is typically lower than what can be supplied by unloading at a rate of 300 mcf per hour.

An abandoned or unused coal mine can have a very large capacity as a capacitor and can receive gas very quickly. Multiple subterranean cylinders and/or oil wells can be manifolded together, to also allow unloading quickly. Oil wells when drilled on 330 feet to 660 feet centers, which is common, makes them close enough that high pressure pipe can be used very economically to connect them together at the unloading facility.

The method of unloading and loading according to the invention reduces the number of transports used, eliminates expensive storage and utilizes an asset, i.e., an abandoned well or mine, that is now worthless. This method makes a huge difference in the economics and will now allow stranded gas to be brought to market lessening dependence on foreign energy.

Compressed Gas In-Grand Capacitors Advantages

Utilizing subterranean cyclinders, and/or unused or abandoned oil wells already in place as subterranean capacitors, to compress the gas up to a high pressure, for instance, 3000 psi, gives the capacitor a geothermal advantage. With the well so deep in the ground, the area or geology of the earth around the well will eventually, after several days, heat up the surrounding rock. This can be used to advantage according to the invention, as the surrounding earth can therefore be used as a thermal insulator for the gas in the capacitor, to conserve the heat thereof. In contrast, if the gas was circulated through several miles of underground pipe, the geothermal action would cool the gas down. The compressor running 24 hours per day every day at 3000 psi would create a tremendous amount of heat, up to 200 degrees. To capture the heat is very difficult if loading every day out of surface storage, due to heat lost to atmosphere. Insulation and/or heaters typically have to be used when the gas is unloaded into the transport. Whereas, in the capacitor of the invention, as a result of the insulating effect, the surrounding rock heats up and retains the heat even after loading a transport every day. It is comparable to the masonry fireplaces where the stone is heated from the fire and then after the fire goes out, the stone will continue to radiate heat for some time. Therefore, the geothermal action keeps the gas stored in the capacitor at an elevated temperature, even after frequent discharging of the capacitor, for instance, every 24 hours.

Another advantage of the invention is keeping the gas at an elevated temperature during loading of a transport from the capacitor, which is done by discharging the gas capacitor. When 3000 psi is discharged initially into the empty transport at 0 psi, the pressure drop is tremendous as is the velocity of the gas flow. This creates a freezing action, such that the temperature of the gas will typically drop 1 degree Fahrenheit for every 15 psi drop in pressure. This will typically drop the temperature 200 degrees over the course of the unloading. This can cause the regulators to freeze even if they are insulated. Gas will also liquefy at 220 degrees below zero, which is also desired to be prevented. The gas stored in a capacitor, because the capacitor is insulating, will retain much of its heat from compression, over time, so as to still be at an elevated temperature when transferred to a tanker. As a result, when loading from one or more capacitors into an initially low pressure tanker, the temperature drop will be from an elevated temperature, much higher than, for instance, the ambient air temperature, such that a freezing action can be avoided. The main problem associated with freezing is that the gas is wellhead gas that has not yet been processed. The gas capacitor is in the field to facilitate transportation from the well head to be processed. Without processing, the gas will contain moisture, which has to be removed during processing. This moisture will cause problems if the gas temperatures are well below zero degrees during loading. The geothermal capability of the gas capacitor of the invention will reduce this problem, because the cooling of the gas can be retarded or slowed by the insulating nature of the earth or the formation surrounding the capacitor or capacitors, so as not to drop in temperature as drastically. This will also facilitate unloading due to the warmer gas from the loading, as even after being transported for several hours, for instance, 1 to 2 hours, the gas in the tanker will still be warmer at unloading.

The Transport Unloading Gas Capacitor

As the gas is unloaded from the capacitor from a pressure of, for example, 3000 psi and loaded into a transport tanker, the gas again will get very cold. This temperature can cause freezing problems before the gas gets to the processing plant. Using a number of wells (or subterranean cylinders) as capacitors at the unloading site, for instance, three wells (or a formation, an unused or abandoned coal mine, or one or more subterranean cylinders), the geothermal action of the normalized temperature of the subterranean surroundings of the capacitor, for instance, about 58 degrees Fahrenheit, will advantageously warm up the gas.

Also, utilizing a well or subterranean cylinder in connection with a geological formation such as sand rock as a gas capacitor will allow the gas to load into the formation while holding pressure in the capacitor. The pressure holding saves pressure from the compression that was generated at the well sites which will eliminate need for a compressor at the unloading site. This pressure can then be used to deliver the gas out of the gas capacitor to the gas processing plant or end user. The gas pressure can be controlled with a pressure reducing regulator from the gas capacitor to the processing plant instead of a compressor. It is anticipated that the formation portion of the capacitor will be able to take several tanker loads of gas before a portion of the gas is to be removed from the capacitor. This provides a cushion in the system which will drive the gas and/or save the pressure during discharging as long as the amount of gas discharged during for instance a 24 hour period is the same that is loaded into the capacitor during the same 24 hour period.

DETAILED DESCRIPTION OF THE INVENTION

Figure 1:
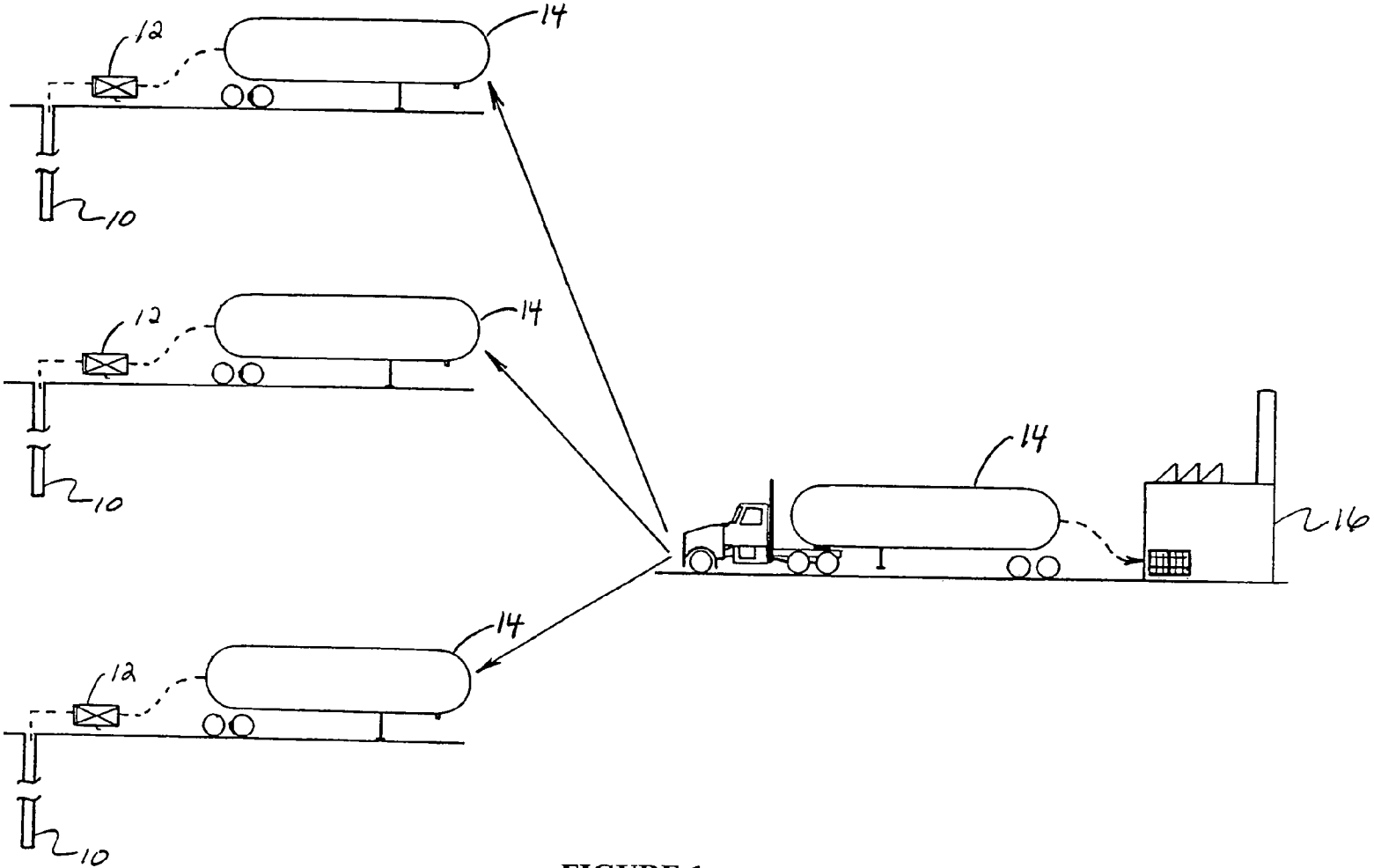
FIG. 1 is a simplified schematic diagram of a prior art method and apparatus for recovering and transporting methane gas.

Referring now to the drawings, wherein like numerals refer to like parts, FIG. 1 illustrates well-known prior art apparatus and methods for recovering and transporting methane gas from a source, such as one or more gas wells in association with one or more underlying coal mines, and transporting the methane gas to an end user, such as, but not limited to, a power generation facility, pipeline, or the like. Essentially, at one or more gas wells 10, conventional, well known apparatus for recovering methane gas therefrom will typically include a compressor 12 in connection with the well 10 using a suitable pipe network (shown by the dotted lines) for receiving or drawing methane gas from a well 10 and compressing the gas into a suitable transport tanker 14. Such tankers 14 are also of conventional, well known construction and operation and can typically hold gas compressed to up to about 3000 psi. At the typical rate at which the methane gas can be extracted and compressed, it will typically take up to 24 hours to compress 300 mcf of methane gas into a tanker 14 at that pressure, which is the typical capacity of a tanker. At an end user, such as a co-firing power plant 16, a typical 300 mcf tanker can be unloaded in about 8 hours, as denoted by the dotted arrow. As a result, for three gas wells 10, it is common to utilize 4 tankers 14, for providing a continuous supply of methane gas to an end-user, such as a co-firing power plant 16. This can be quite expensive capital wise, as tankers, such as the tankers 14, can cost several hundred thousand dollars each.

At the loading end, typical tankers 14 must be loaded relatively slowly, for instance, over a 24 hour period, because the compressing of the gas results in heating of the gas, which can cause dangerous overheating of the tanker 14, if filled too quickly. At the end user site, when the gas is unloaded, if done too quickly, the unloading apparatus, as well as regions of the tanker 14, can be subjected to freezing, which can also be a dangerous and/or damaging condition. As an alternative, it has been contemplated to utilize above ground gas storage tanks in connection with one or more gas wells, such as wells 10 illustrated. However, above ground storage tanks still must be filled slowly, and represent a significant capital expense. As another factor, at the loading end, if the ambient temperature is hot, and/or the tanker 14 is exposed to significant sun light, the ability of the tanker 14 to dissipate heat can be reduced, thereby requiring slower loading. Similarly, at the unloading end, if ambient temperatures are low, and/or it is dark or cloudy, unloading speed may have to be reduced, to minimize freezing of the tanker and unloading apparatus. Also at the unloading end, it has been contemplated to utilize above ground storage tanks. However, the gas must typically be compressed into the above ground tank. Thus, the capital expenditures and operating costs can be significant, making this an uneconomical alternative.

Figure 2:
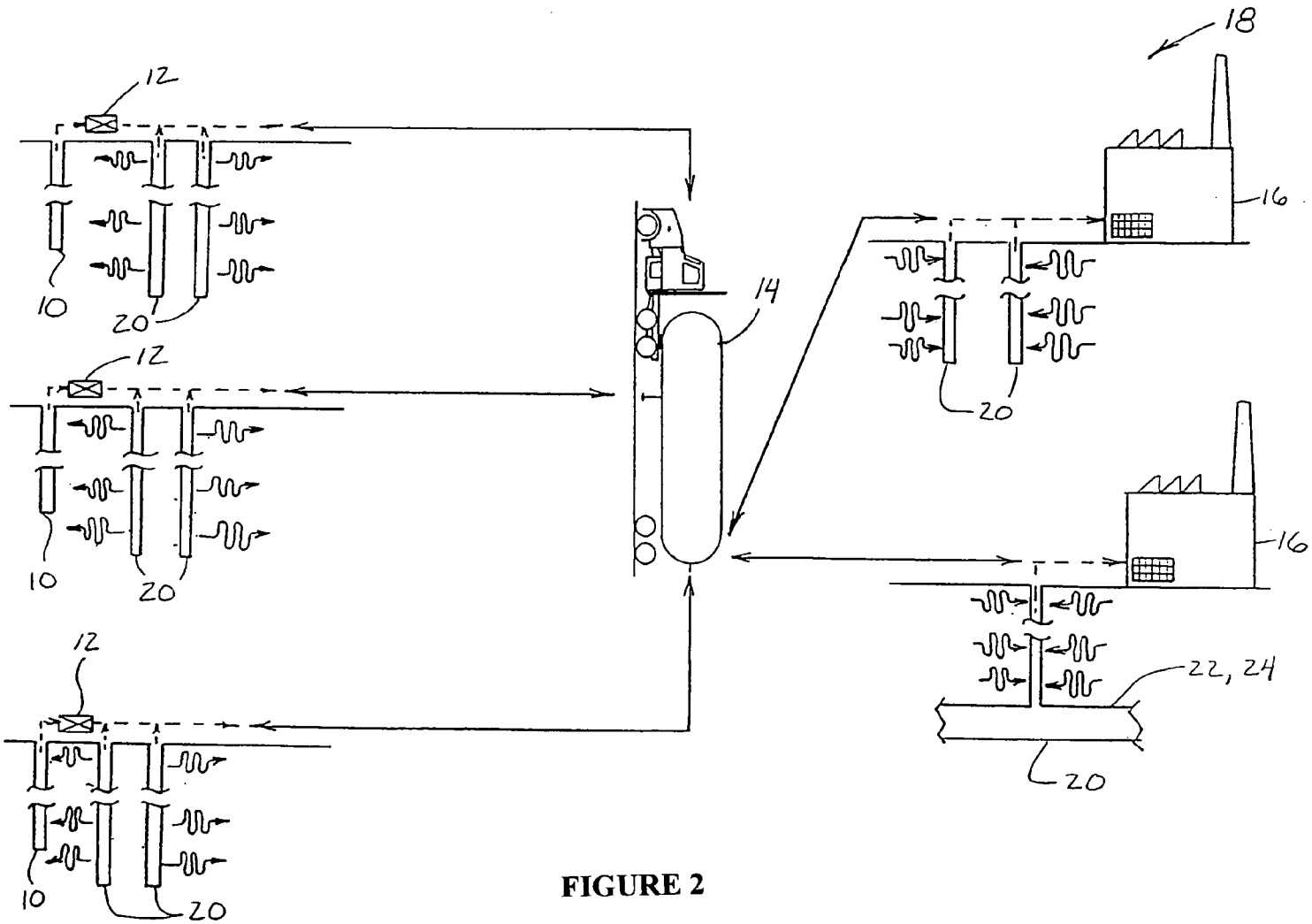
FIG. 2 is a simplified schematic diagram of a method and apparatus of the invention for recovering and transporting methane gas.

Referring also to FIG. 2, elements of a system, method and apparatus 18 of the present invention for recovering and transporting methane gas from a source, e.g., a producing well, such as one or more gas wells 10, to and end user, such as, but not limited to, co-firing power plant 16, is shown. Apparatus 18 of the system of the invention preferably includes at least one, and more preferably two or more, subterranean capacitors 20, in the vicinity of each gas well 10, into which methane gas from a producing well 10 can be compressed, by a compressor, such as compressor 12 shown, or other suitable apparatus. Each capacitor 20 can be a non-producing oil well, a producing oil well (FIG. 3), or a subterranean cylinder, having a capability of receiving and holding compressed methane gas, at a suitable pressurization, such as the 3000 psi pressure typically used in transport tankers, such as tanker 14. Some oil wells have been found to have the capacity to hold gas pressurized to up to 4000 psi without significant leakage. A typical oil well (or subterranean cylinder) which is suitable for use as a capacitor 20, will be several hundred feet deep, and, more preferably, will be several thousand feet deep, for instance, 3000 feet deep, which is a common depth of oil wells found in the vicinity of coal mines in the Southern Illinois and Western Kentucky regions of the USA, where methane is typically found in extractable quantities in coal mines and is presently extracted using gas wells such as the wells 10. A suitable oil well (or subterranean cylinder) utilizable as a capacitor 20 of the invention will be of a diameter of several inches, for instance, 4 to 10 inches, and commonly 8 inches in diameter, and will be encased in a steel casing. An oil well (or subterranean cylinder) utilized as a capacitor 20 may also include a smaller diameter production tube extending downwardly therethrough. The oil well (or subterranean cylinder) will also typically be encased in cement or concrete. As noted above, oil wells such as this are commonly found in the vicinity of gas bearing coal mines, and are often considered to be a liability to the owners of the oil wells, as they can cost several thousand dollars to plug. Thus, the owners of such oil wells are often eager and willing to allow alternate usage of them.

It has been found that a 3000 foot deep oil well (or subterranean cylinder) having an 8 inch diameter casing can receive and hold 300 mcf of methane gas at a pressurization of 3000 psi. Thus, two capacitors 20 in the vicinity of a producing gas well 10 can be expected to be capable of holding 600 mcf of methane gas, which would equal the capacity of two tankers 14. As a particular advantage of using at least one, and preferably two or more, capacitors 20 for receiving and holding gas extracted from a gas well 10, no transport tanker 14 or above ground storage tank is required to be present, and the compressing of the gas into the one or more capacitors can be performed on a continuous, or 24 hour a day, basis. It has been found that a smaller compressor 12 can be used, compared to that which is typically used for compressing gas into a transport tanker 14.

Additionally, the earth surrounding and in intimate contact with each of the capacitors 20 will have a normalized temperature which is equal to the average temperature in that region, for instance, in the mid-50° range, as is common in the Southern Illinois and Western Kentucky region. As a result, it has been found that the surrounding earth will serve as an excellent heat insulator for holding heat in the compressed gas, such that the gas will lose heat only slowly, and thus, will remain at an elevated temperature. And, because the gas is not being compressed into a tank, overheating is not as great a concern. Heat dissipation into the surrounding earth is represented by the wavy arrows emanating from each of the capacitors 20. This represents the slowed heat transfer resulting from the insulating effect of the surrounding earth.

Still further, as a particular advantage, when a tanker is connected to one or more capacitors 20, it has been found that loading can be achieved quickly, because little or no compression of the gas being drawn from the capacitor or capacitors 20 is required, as the gas in the capacitor or capacitors 20 is already compressed to, or close to, the desired pressurization of 3000 psi.

It has further been found that 2 capacitors 20 such as described above, holding 600 mcf of methane gas can be loaded relatively quickly, for example, in one half hour or less. One reason for this is that the temperature drop experienced as a result of transfer to the initially lower pressure environment of the tanker, will be from the elevated temperature of the capacitor, not an ambient air temperature or the like, such that the end temperature will not be as close to the freezing temperature of the gas.

One or more capacitors 20 according to the present invention can also be advantageously utilized at the end user or other unloading site. Such capacitors 20, can be one or more of any of several different forms. For instance, a capacitor 20 could be an existing well, such as a producing or nonproducing oil well, as just explained. A capacitor 20 could also include an abandoned or unused coal mine 22, or an underground formation of rock 24, such as sand rock or the like. Still further, a capacitor 20 could also include a subterranean cylinder that is constructed near the producing well 10 for the sole purpose of receiving and storing gas in the cylinder, as described herein. Prior to connection of a loaded tanker, such as tanker 14, to a capacitor or capacitors 20 at the unloading or end-user site, the capacitor or capacitors 20 can be preloaded with pressurized gas. This can provide several advantages, including, but not limited to, the ability to unload into an already pressurized environment, such that the gas being unloaded is not and greatly chilled as would occur if unloaded into a much lower pressure environment. The gas holding capacity of the capacitors 20, particularly, a large formation of sand rock or the like, or a coal mine, can be quite large, for instance, larger than the capacity of a single tanker. As a result, when the gas is withdrawn from the capacitors 20, the remaining pressurized gas in the capacitors 20 can provide adequate pressure for the unloading of the gas. Thus, the gas in the formation can act as, or provide, a cushion in the gas holding system which will facilitate absorption of the gas into the system, and then drive the gas being unloaded from the system. Still further, by unloading the gas from a tanker into an already pressurized capacitor or capacitors 20, less depressurization occurs, resulting in less temperature drop in the gas. Once in the capacitor or capacitors 20, heat from the surrounding formation can be absorbed into the pressurized gas contained in the capacitor or capacitors 20, as illustrated by the wavy arrows, so as to raise the temperature thereof, such that there will be less occurrence of freezing of regulators and other apparatus as the gas is withdrawn therefrom. In the instance of a capacitor which is an oil well (or subterranean cylinder), it is preferred to use an oil well (or subterranean cylinder) having an internal casing diameter of several inches, for instance, 8 inches, and a depth of at least several hundred feet, and preferably several thousand feet, for instance, 3000 feet as commonly found in unused oil wells in the southern Illinois and Kentucky regions of the United States.

Still further, at the unloading end, when pressurized gas from a tanker 14 is unloaded into an already pressurized capacitor 20, little or an insignificant amount of the original pressurization from the loading process is lost, and, when the gas is withdrawn from the capacitor 20, it is typically desired to be at a substantially lower pressure, for instance, less than 100 psi, such that no compressor capability is required at that site. Cost of additional compressing of the gas at that location is also avoided. If it is desired or required to further pressurize gas introduced into a capacitor or capacitors 20 at the unloading site, when a compressor is used and the gas is resultantly heated, the surrounding formation can again serve as a heat sink for dissipating the extra heat, as explained above.

Figure 3:
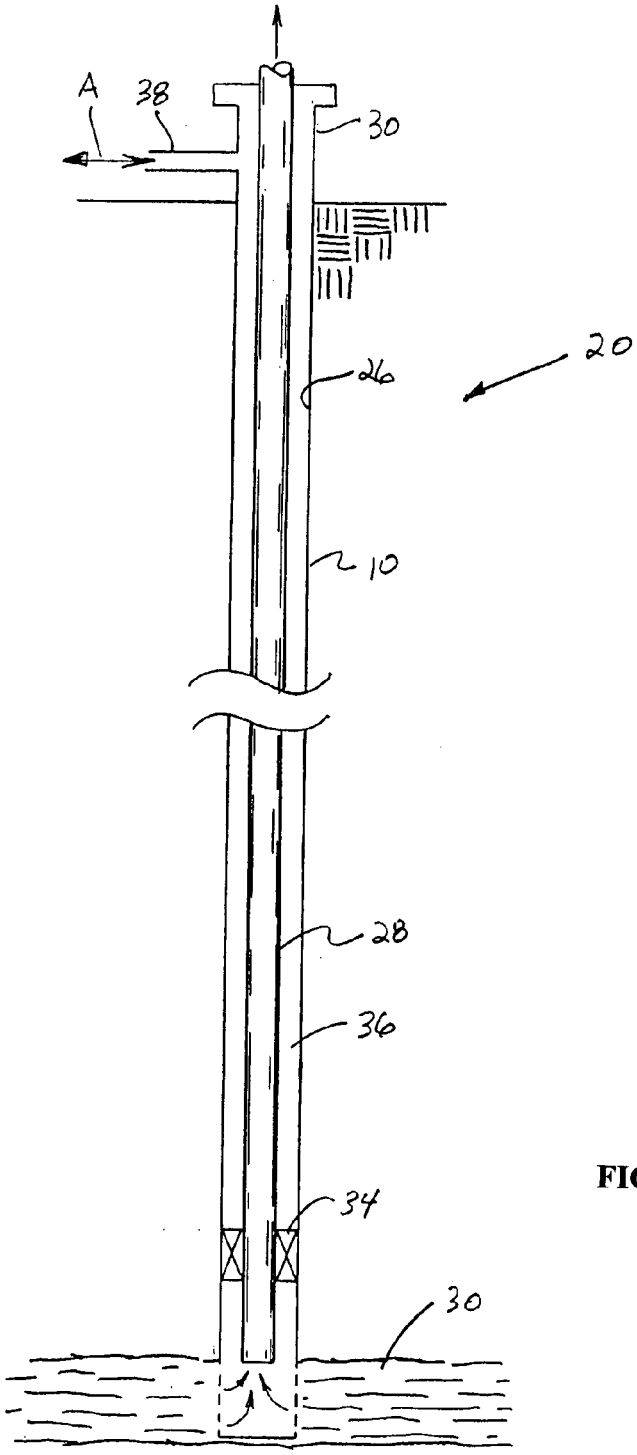
FIG. 3 is a simplified side view of an oil well adapted for use as a capacitor according to the invention.

Referring also to FIG. 3, a producing oil well 10, is illustrated, used as a capacitor 20 according to the teachings of the present invention. Well 10 includes a casing 26 which can be of several inches in diameter, for instance 8 inches, as is commonly used for casing wells in the southern Illinois and Kentucky regions. Well 10 can be several thousand feet deep, for instance 3000 feet deep, as is also common in those regions. A well 10 will often include a much smaller diameter tube 28, for instance of about 2 inches, extending therethrough which extends from the wellhead 32 and underlying gas or oil formation 32 for drawing gas or oil therefrom, as denoted by the arrows, for instance, using formation pressure and/or pumping. To facilitate use as a capacitor 20, a plug 34 can be inserted in the oil well 10 at a desired depth above the producing formation 30, for isolating an annular space 36 surrounding tube 28 above formation 30, from the formation 30, such that the space 36 can be used as the capacitor for receiving and holding compressed gas introduced into space 36 through a port 38, as denoted by arrow A. Port 38 can also be used for unloading capacitor 20, in the above described manner. As a result, it should be evident that either a producing or nonproducing well can be utilized as a capacitor 20 according to the present invention. Such wells have been found to have a pressure capacity of 4000 psi, which renders the wells suitable for use as a capacitor at a pressure of the desired 3000 psi.

Oil fields, such as in the southern Illinois and Kentucky regions of the United States, commonly include wells drilled in a predetermined pattern, such as on 330 feet for 660 feet center to center spacings. Such distances are sufficiently small such that two or more of the wellheads can be economically connected together by high-pressure pipe. This is true both at the loading site and also the unloading site, such as an end user or the like.

Thus, there has been shown and described a novel method and apparatus for recovering and transporting methane gas which overcomes many of the problems set forth above. It will be apparent, however, to those familiar in the art, that many changes, variations, modifications, and other uses and applications for the subject device are possible. All such changes, variations, modifications, and other uses and applications that do not depart from the spirit and scope of the invention are deemed to be covered by the invention which is limited only by the claims which follow.

What is claimed is:

1. A method for recovering and transporting gas, which comprises the steps of:

(a) transferring gas from a producing well to one or more subterranean capacitors and storing the gas in said one or more capacitors;

(b) loading the gas from the one or more subterranean capacitors into a tanker at a rate that would be effective to load 300 mcf of gas to a pressure of at least about 3000 psi in thirty minutes or less; and (c) transferring the gas via the tanker to a second subterranean capacitor, a pipeline, an end user, a gas processor, or a power plant.

2. The method of claim 1, wherein the one or more subterranean capacitors and second subterranean capacitor are constructed from a formation selected from the group consisting of an oil well, coal mine, underground rock formation, and a subterranean cylinder.

3. The method of claim 2, wherein the gas is selected from the group consisting of methane gas, natural gas, combinations thereof, and constituents thereof

4. The method of claim 3, wherein the one or more subterranean capacitors is a subterranean cylinder.

5. The method of claim 4, wherein the subterranean cylinder is installed for the purpose of storing gas therein.

6. The method of claim 5, wherein the subterranean cylinder has a diameter ranging between 4 and 10 inches.

7. The method of claim 5, wherein the subterranean cylinder is at least 300 feet in length.

8. The method of claim 5, wherein the subterranean cylinder is at least 3000 feet in length.

9. The method of claim 5, wherein the subterranean cylinder is capable of holding at least 300 mcf of methane gas at a pressurization of at least 3000 psi.

10. The method of claim 5, wherein gas is transferred from the producing well to the one or more subterranean capacitors via (i) a tanker, (ii) a pipeline, or (iii) any combination thereof.

11. The method of claim 10, wherein the power plant is a co-firing power plant.

12. A method for recovering and transporting gas, which comprises the steps of:

(a) transferring methane gas, natural gas, or a combination thereof from a producing well to a first subterranean capacitor and a second subterranean capacitor;

(b) loading the gas from the first subterranean capacitor into a tanker at a rate that would be effective to load 300 mcf of gas to a pressure of at least about 3000 psi in thirty minutes or less;

(c) moving the tanker from the first subterranean capacitor to the second subterranean capacitor;

(d) loading the gas from the second subterranean capacitor into the tanker at a rate that would be effective to load 300 mcf of gas to a pressure of at least about 3000 psi in thirty minutes or less; and (e) transferring gas from the second subterranean capacitor via the tanker to a third subterranean capacitor, a pipeline, an end user, a gas processor, or a power plant, wherein the first and second subterranean capacitor is a subterranean cylinder that is capable of holding at least 300 mcf of methane gas at a pressurization of at least 3000 psi.

* * * * *